US012607122B2

(12) United States Patent
Guanziroli

(10) Patent No.: US 12,607,122 B2
(45) Date of Patent: Apr. 21, 2026

(54) AUTOMATED METHOD AND PROCESSING TRAIN FOR LINING TUNNELS

(71) Applicant: HINFRA S.R.L., Casale Monferrato (IT)

(72) Inventor: Stefano Guanziroli, Erba (IT)

(73) Assignee: HINFRA S.R. L., Casale Monferrato (IT)

( * ) Notice: Subject to any disclaimer, the term of this patent is extended or adjusted under 35 U.S.C. 154(b) by 367 days.

(21) Appl. No.: 18/259,131

(22) PCT Filed: Dec. 22, 2021

(86) PCT No.: PCT/IB2021/062178

§ 371 (c)(1),
(2) Date: Jun. 23, 2023

(87) PCT Pub. No.: WO2022/137157

PCT Pub. Date: Jun. 30, 2022

(65) Prior Publication Data

US 2024/0052743 A1 Feb. 15, 2024

(30) Foreign Application Priority Data

Dec. 23, 2020 (IT) ..... 102020000032327

(51) Int. Cl.
*E21D 11/10* (2006.01)

(52) U.S. Cl.
CPC ..... *E21D 11/102* (2013.01); *E21D 11/107* (2013.01)

(58) Field of Classification Search
CPC ..... E21D 11/102; E21D 11/107; E21D 11/10; E21D 11/04; E21D 11/105; E21F 15/08; E04G 21/06; H05B 3/60
See application file for complete search history.

(56) References Cited

U.S. PATENT DOCUMENTS 3,827,244 A * 8/1974 Walbrohl ..... E21D 11/102 405/141
4,063,425 A * 12/1977 Jutte ..... E21D 11/385 405/145

(Continued)

FOREIGN PATENT DOCUMENTS

| | | | |
|---|---|---|---|
| CN | 109139043 | A | 1/2019 |
| CN | 110195603 | A | 9/2019 |
| WO | 0227142 | A1 | 4/2002 |

OTHER PUBLICATIONS

International Search Report and Written Opinion, issued in PCT/IB2021/062178, mailed Apr. 20, 2022, Rijswijk, NL.

*Primary Examiner* — Edwin J Toledo-Duran
(74) *Attorney, Agent, or Firm* — ArentFox Schiff LLP; Michael Fainberg

(57) ABSTRACT

A processing train configured to run along a tunnel to lay a solidifiable fluid material on a wall of the tunnel and allow the solidifiable fluid material to solidify for construction of a lining of the tunnel, an advancement system for advancing the sliding form, a closing edge for closing a space between a front edge of the sliding form and the wall of the tunnel, and spouts for dispensing the solidifiable fluid material around a front segment of the sliding form. A method for constructing a lining of a tunnel with the solidifiable fluid material involves, defining an interspace between the front segment of the sliding form and the wall of the tunnel, introducing the solidifiable fluid material into the interspace and, after hardening time, advancing the sliding form to form a new interspace and successive lining sections.

15 Claims, 6 Drawing Sheets

(56) References Cited

U.S. PATENT DOCUMENTS

| | | | | | |
|---|---|---|---|---|---|
| 4,147,453 | A | * | 4/1979 | Unger | E21D 9/0692 405/141 |
| 4,407,609 | A | * | 10/1983 | Cerutti | E21D 11/102 249/11 |
| 4,437,788 | A | * | 3/1984 | Walbrohl | E21D 11/102 405/141 |
| 4,621,947 | A | | 11/1986 | Babendererde et al. | |
| 4,789,267 | A | * | 12/1988 | Babendererde | E04G 21/06 405/150.1 |
| 4,820,458 | A | * | 4/1989 | Babendererde | E21D 11/102 264/269 |
| 4,856,936 | A | * | 8/1989 | Hentschel | E21D 11/102 405/145 |
| 5,253,955 | A | * | 10/1993 | Walbrohl | E21D 11/102 264/32 |

* cited by examiner

AUTOMATED METHOD AND PROCESSING TRAIN FOR LINING TUNNELS

CROSS-REFERENCE TO RELATED APPLICATIONS

This application is a National Phase Application of PCT International Application No. PCT/IB2021/062178, having an International Filing Date of Dec. 22, 2021 which claims priority to Italian Application No. 102020000032327 filed Dec. 23, 2020, each of which is hereby incorporated by reference in its entirety.

FIELD OF THE INVENTION

The present invention relates to an innovative method and an innovative processing train for lining tunnels.

Here the term "tunnel" will be understood as meaning tunnels which can be travelled along, such as railway or road tunnels, and ducts for transporting for example fluids, such as sewage ducts or the like, etc.

The lining may be formed both in a tunnel which is undergoing construction and in an existing tunnel in which it is required to repair or replace the existing lining. In particular, according to one object of the present invention, it is to be considered that the extraordinary maintenance of tunnels is a subject of particular interest, also from a social point of view. In fact, the common practice when completely resurfacing the shell of a tunnel does not involve automated methods for the demolition, waterproofing and construction of the new manufactured element. The various operations are performed singly with very long execution times.

BACKGROUND OF THE INVENTION

The use of conventional systems, where the operations are separate from each other, results in the resurfacing work typically progressing by a few linear metres per day (usually 1 to 5 metres at the most).

The use of the solution proposed here guarantees among other things a significant increase in the speed of execution of the tunnel resurfacing work, allowing rapid positioning of the new lining material, which may develop a high strength in an extremely short period of time, while ensuring the possibility of continuous or near continuous displacement of the processing train. This represents a marked difference from the existing prior art.

In the prior art various methods for constructing the structural lining of tunnels have been proposed. For example it has been proposed to construct reinforcements which are shaped like the vaults of the tunnel and inside which the concrete is introduced. Once the lining has solidified, the reinforcements are then disassembled and removed. In the case of tunnels which have a certain length it is however necessary to have a large quantity of reinforcements and a considerable amount of time is needed for assembly and disassembly thereof. In order to reduce the need for large quantities of reinforcements it has also been proposed to proceed one segment at a time, namely to assemble the reinforcements only for one section of the tunnel, so as to form the lining along this section, and then disassemble the reinforcements once the lining has fully hardened and reassemble them along the next section, and so on, as far as the end of the tunnel. This however does not reduce the construction time and the work needed for assembly and disassembly of the reinforcements. Moreover the joints between one section and the next section may be the source of structural and waterproofing problems owing to the limited adherence of the lining of a section formed against the preceding section which has already been completely stabilized.

It has also been proposed to use dual-component solidifiable fluid products which can be sprayed onto the vaults, namely a structural product to which, immediately before spraying, an accelerating agent is added in order to cause the near immediate solidification thereof and adherence to the walls of the tunnel. This solution is however suitable for forming the first reinforcing layer of a new tunnel, but is not always suitable for forming the final structural lining which also requires the formation of reinforcements and further processing operations. Moreover, owing to the poor surface finish which is obtained with this solution, finishing operations are also needed and these increase the construction times and costs. Systems where the concrete is introduced from a front end of a form, in some cases a sliding form, have also been proposed. The introduction of concrete from the front of the form, however, slows down the operation and the result is often unsatisfactory.

CN109139043 describes a method and a machine for the construction of new sewage tunnels. According to this patent, while a machine excavates the tunnel, stabilization blocks are also arranged in position and concrete is introduced between them and a form in order to create a secondary lining. This slows down the construction of the tunnel and does not avoid the use of prefabricated elements which are suitable solely for the specific construction of the sewage channel.

WO02/27142 describes a system for lining tunnels with the lining material which is sprayed onto the vault of the tunnel by means of a spraying nozzle which is moved by means of a carriage with a radial pantograph which moves along the circumference. A sliding form provided with a sheet of non-adhesive material advances over the sprayed material and has the function of smoothing the lining layer after it has been sprayed from the outside towards a front end of the form.

U.S. Pat. No. 4,789,267 describes a system for hardening concrete by means of heating. The concrete is introduced from the front end of a form by means of a tube and, once it has hardened as a result of heating, the segments of the form are removed and repositioned along the tunnel.

U.S. Pat. No. 4,437,788 describes a method for forming a tunnel with a sliding form, the concrete being introduced from a front end of the form. The form has parts which can be disassembled and removed so as to allow the introduction of a lubricant which should facilitate sliding.

U.S. Pat. No. 4,820,458 describes an apparatus for forming tunnel linings which has a circumferential ring to be placed on the front end of a form in order to introduce the concrete from the front of the form.

CN110195603 describes a plate with a gate valve for dispensing a material for lining tunnels.

U.S. Pat. No. 4,621,947 describes a method for the construction of new tunnels which involves excavating, inserting a shield protecting the excavation, positioning a form against the shield, positioning a movable wall and injecting pumped concrete. The movable wall is moved by the pressurised concrete alone using a spring mechanism which is operated once the minimum pressure of the concrete injected from front spouts is reached.

In addition to the slow speed and an often unsatisfactory end result, one problem which is common to all the known methods is also that of not allowing the rapid realization of structural linings to replace existing linings which are in bad condition. In fact, in these situations the tunnel is generally already in use and the interruption in use which is required in order to implement the known methods for removal of the old lining and formation of the new lining is often incompatible with the need to reduce to a minimum the tunnel closing times.

SUMMARY OF THE INVENTION

The general object of the present invention is to provide a method and a processing train which allow the fast, automated, efficient and structurally robust construction of linings in tunnels which are both new and in particular have old lining which must be replaced.

In view of this object the idea which has occurred, according to the invention, is to provide a processing train intended to run along the tunnel so as to lay a solidifiable fluid material on the walls of the tunnel and allow it to solidify for the construction of a lining of the tunnel, characterized in that it comprises: a sliding form with the lateral shape of the desired lining on the walls of the tunnel; a system for advancing the form, suitable for its advancement stepwise along a tunnel; a closing edge intended to close, radially with respect to the tunnel, the space between a front edge of the sliding form and the wall of the tunnel; spouts for dispensing the solidifiable fluid material around a radially external front segment of the sliding form.

Still in accordance with the principles of the invention, the idea which has occurred is to provide a method for constructing a lining of a tunnel with solidifiable fluid material, by means of a processing train which is advanced stepwise along the axis of a tunnel, comprising at least the steps of:

a) using a sliding form in the processing train, having the lateral shape of the desired lining on the walls of the tunnel and extending over a section of the tunnel, so as to define an interspace between a front segment of the sliding form and the wall of the tunnel, the interspace being closed at the front by means of a closing edge which extends radially with respect to the axis of the tunnel between the sliding form and the wall of the tunnel;

b) introducing the solidifiable fluid material into said interspace;

c) waiting for a given solidification time;

d) advancing the sliding form by one step inside the tunnel so as to form a new interspace which is situated between the front section of the sliding form and the wall of the tunnel and which borders at the rear with the solidifiable fluid material introduced during point b) into the preceding interspace;

repeating steps b) to d) to create successive lining sections of the tunnel.

BRIEF DESCRIPTION OF THE DRAWINGS

In order to illustrate more clearly the innovative principles of the present invention and its advantages compared to the prior art, examples of embodiment applying these principles will be described below with the aid of the accompanying drawings. In the drawings.

DETAILED DESCRIPTION

Figure 1:
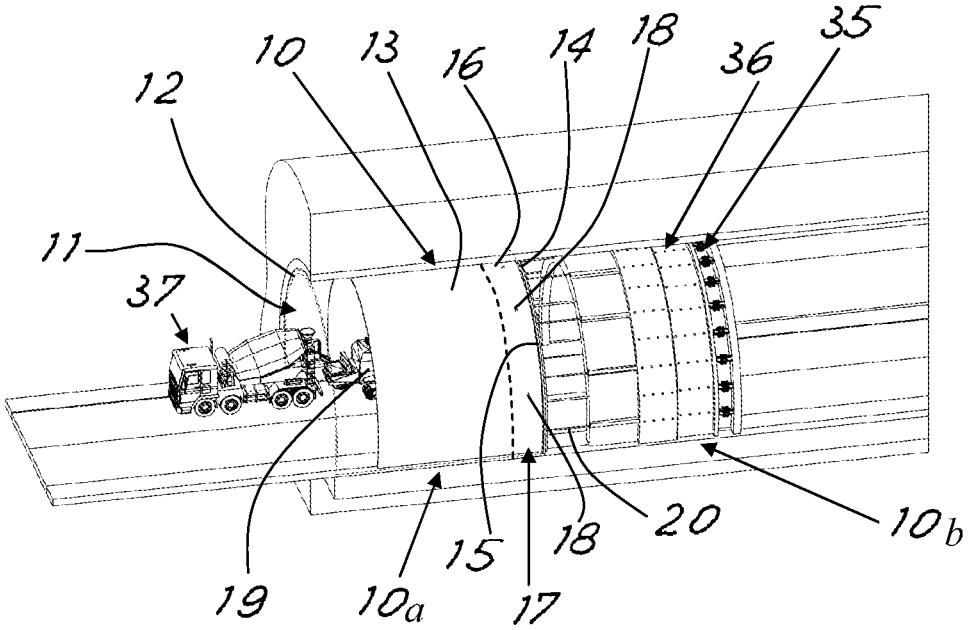
FIG. 1 shows a schematic, partial, perspective view of a processing train provided in accordance with the invention.

With reference to the figures, FIG. 1 shows a processing train according to the invention, denoted generally by 10.

The processing train 10 is intended to run along a tunnel 11 so as to lay a solidifiable fluid material with suitable mechanical characteristics on the walls of the tunnel and allow it to solidify, so as to form a lining 12 of the tunnel.

The processing train 10 comprises a sliding form with the lateral shape of the desired lining on the walls of the tunnel. For example, in the case of a vault tunnel (in particular, but not exclusively a road or railway tunnel), the form may have a structure with a generally semi-circular cross-section. The form 13 may also be made in sections which can be assembled together.

The train 10 also comprises a system for advancing the form, suitable for its advancement, which may be automated, stepwise along a tunnel, as will be clarified below. The movement system may depend also on the type of tunnel. For example, in the case where there is a floor which can be travelled along by means of a wheel system, the train may also comprise a suitable number of wheels, as shown in the figures. In particular, the train may leave inside it a central path which is free so that the tunnel may in any case be travelled along for the required processing operations (for example, removal of the excavation material by means of diggers and lorries) or, if necessary or preferable, so as to allow the circulation of road or railway traffic in safe conditions. For example, the train may have an arch-like cross-section as is clear also from FIG. 5.

Figure 2:
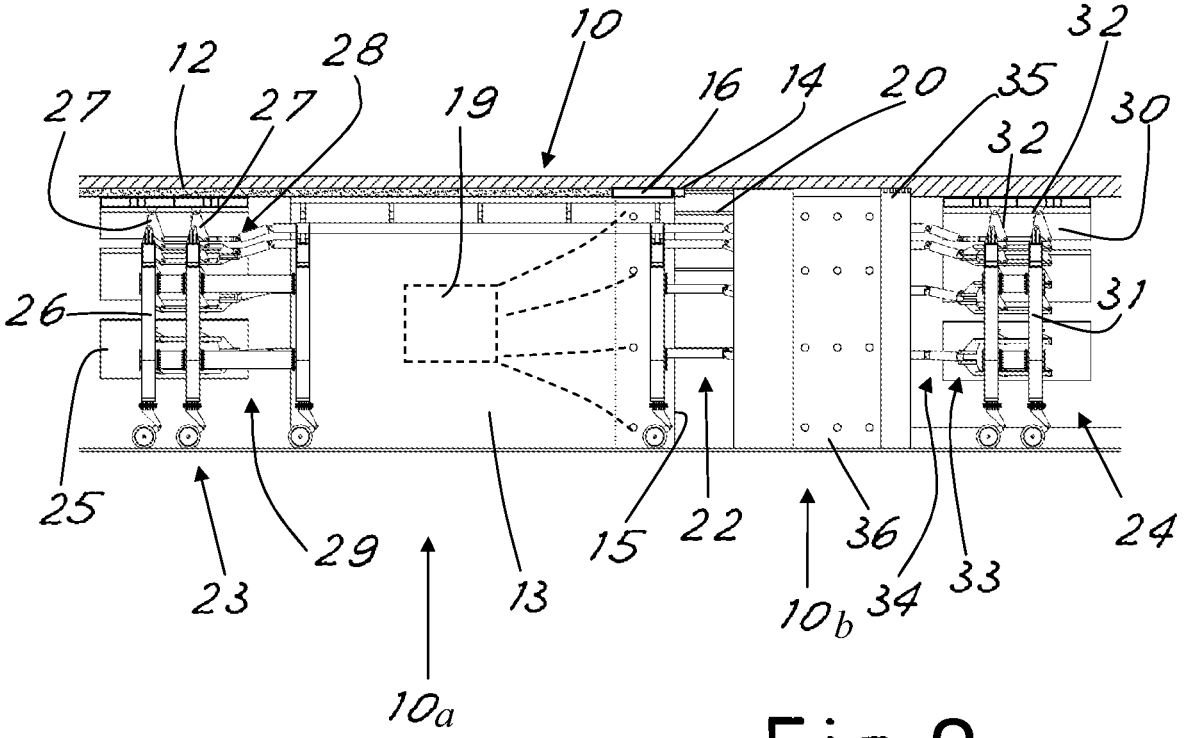
FIG. 2 shows a schematic longitudinally sectioned view of a processing train provided in accordance with the invention, in a first operating position.

As can be clearly seen also in the embodiment of FIG. 2, the processing train also comprises a closing edge 14 which is intended to close, radially with respect to the tunnel, the space between a front edge 15 of the sliding form 13 and the wall of the tunnel. In this way, in at least a first operating position of the processing train 10, the form 13 with the closing edge 14 may define an interspace 16 between a radially external front segment 17 thereof and the wall of the tunnel.

The front segment 17 of the form is provided with spouts 18 for dispensing the solidifiable fluid material so as to introduce it inside the interspace. As can be clearly seen in the figures, the dispensing spouts are advantageously distributed around the radially external surface of the front segment 17, namely the surface of the front segment of the form facing the wall of the tunnel. The lining material is thus dispensed inside the interspace between the external radial surface of the form and the facing wall of the tunnel. As can be clearly seen again in the figures, the dispensing spouts, in addition to being able to be distributed circumferentially around the external surface of the segment 17 of the form, may also be distributed axially (namely in the direction of the axis of the tunnel), so as to form a broad surface for emission of the solidifiable material inside the space between form and wall of the tunnel. The spouts may also be distributed over the whole radially external surface of the front segment which forms the new segment of the lining, as shown in the figures. The emission of the fluid is thus rapid and uniform. The dispensing spouts may for example be connected to a source 19 containing said solidifiable fluid material in its fluid state. The source 19 will emit, on command, the fluid with a suitable pressure and flowrate so that it is forced to fill the interspace via the dispensing spouts 18. The source 19 may for example be filled at intervals by means of concrete mixer lorries 37 (or other vehicles depending on the type of tunnel). The mixture of the raw materials (solids and liquids) which form the fluid material may be incorporated in the processing train.

By using this processing train according to the invention it is possible to introduce into the interspace 16 the solidifiable fluid material until it is filled by the desired amount (generally completely) and then wait for a given solidification time (which may be understood as being the curing time and may also be only partial) and then advancing the sliding form inside the tunnel by one step in order to form a new interspace 16 which borders at the rear with the solidifiable fluid material introduced during the preceding step.

The solidification before advancing of the form must not necessarily be total since it is possible to perform the advancing movement (and therefore define the length of the interspace in the direction of advancement) in such a way as to keep the form still pressed again the fluid material introduced into the preceding interspace for a desired number of advancement steps. It is thus possible to keep supported the fluid material which is solidifying for the whole time necessary for performing said desired number of advancing steps. This time may be easily calculated so that the fluid material has solidified sufficiently at least so as to become self-supporting when it emerges from the rear part of the form 13 which slides forwards.

Figure 3:
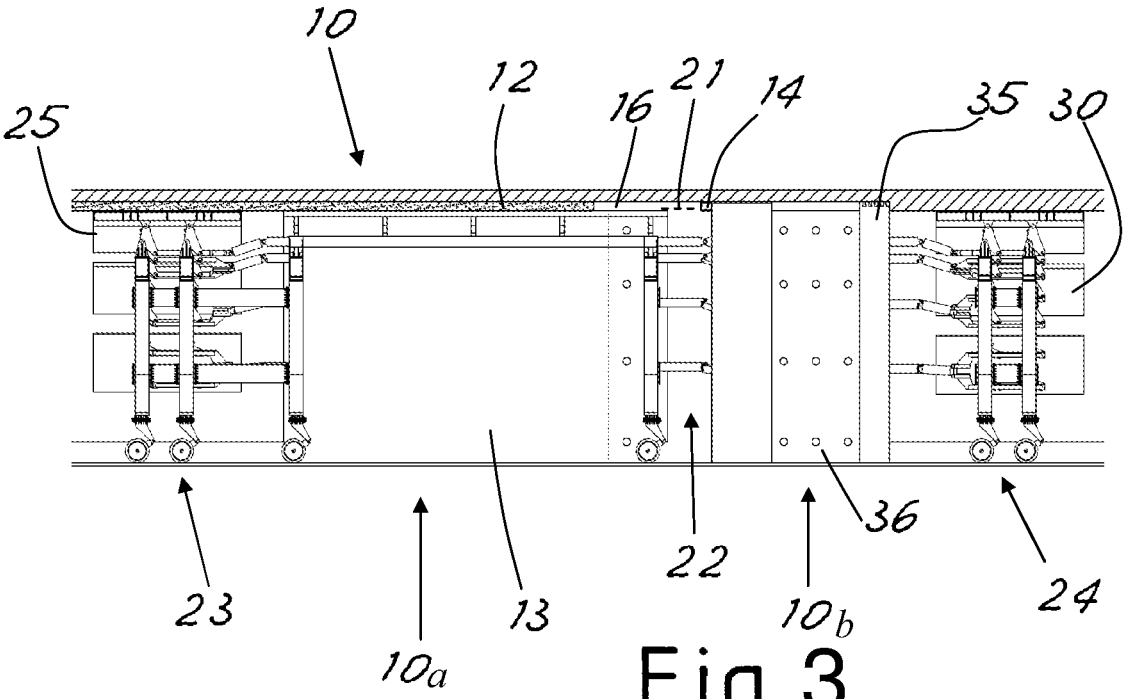
FIGS. 3 and 4 show schematic longitudinally sectioned views of the processing train according to FIG. 2, in two different possible operating positions.

Advantageously, the closing edge 14 may also be designed so as to be movable between an operative position against the front edge 15 of the sliding form and a rest position spaced from the operative position so as to open at the front the interspace 16 as shown for example in FIG. 3. Suitable actuators 20 (for example hydraulic pistons or electric gear motors with linear mechanical transmission) may be present to move on command the edge 14 between its positions.

When the closing edge is in its non-operative position, it is possible to create a space between edge and form such as to allow the preparation and introduction inside the interspace of a known reinforcement mesh (indicated for example by 21 in FIG. 3) to be incorporated in the solidifiable fluid material which is then introduced into the interspace. The reinforcement for example may be formed by iron rod cages. This reinforcement may also be made beforehand in suitable separate sections so that they can be transported inside the processing train and then assembled in the space between closing edge and form.

Advantageously, in order to introduce the reinforcement 21 into the interspace 16, the reinforcement may be placed between the form 13 and the closing edge 14 when the edge is in its non-operative position, and then the closing edge may be moved towards the operative position so that, during the movement towards the closed position, it pushes the reinforcement towards and inside the interspace.

Owing to the dispensing from spouts distributed around the radially external surface of the form, the immersion of the reinforcement within the solidifiable fluid material is optimal, thus avoiding problems of empty pockets or bubbles which may otherwise remain inside the mass of the fluid material once it has solidified.

The closing movement between edge and form may obviously be understood as being also a relative movement. Namely, it may also be envisaged that the closing edge may remain stationary with respect to the tunnel and the form may advance in order to reach it and with this movement cover the reinforcement. This movement of the form with respect to the edge may be advantageous for example in the case where it is required to fix the reinforcement to the walls of the tunnel before immersing it in the fluid material.

Advantageously, the movable edge 14 in the operative position may also be kept stationary, while the form advances by one step after introduction of the fluid material into the interspace, so as to prevent the fluid material which has not yet solidified sufficiently from being drawn forwards together with the sliding form. This is shown by way of example in FIG. 4.

As shown in the figures, the processing train according to the invention may advantageously comprise optionally a rear part 10*a* and a front part 10*b* which are interconnected. In this case, the sliding form 13 will be in the rear part, while the front part may be of a type suitable for preparing the walls of a section of the tunnel for subsequent lining with the solidifiable fluid material.

Figure 4:
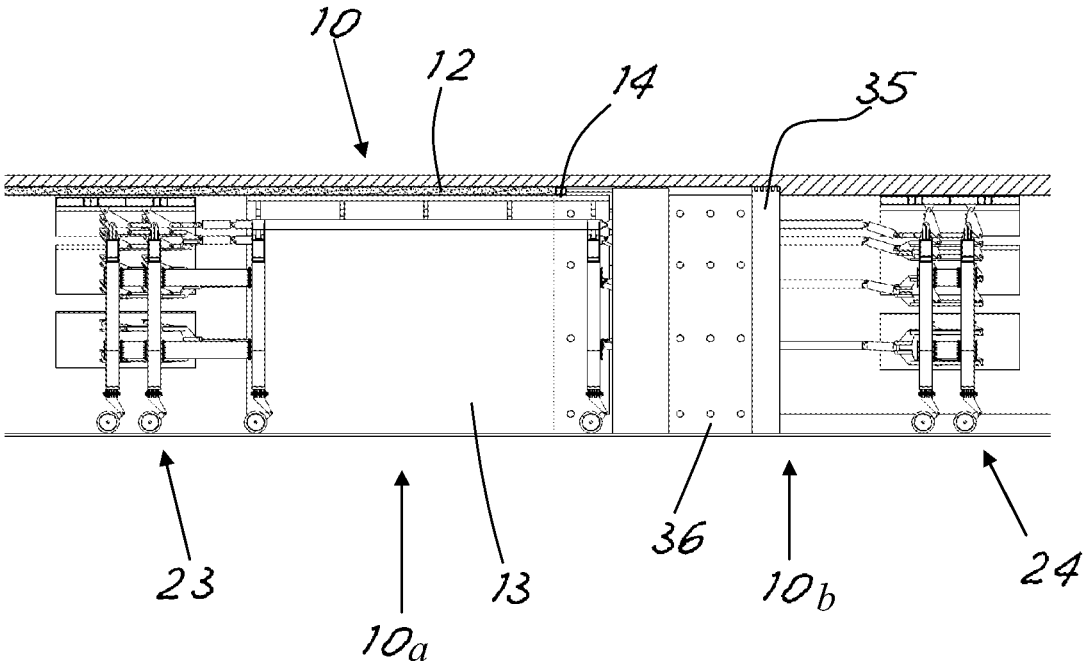

As can be seen from a comparison for example of FIGS. 3 and 4, the rear part 10*a* and the front part 10*b* may be interconnected so that they may be moved towards and away from each other on command in the stepwise advancing direction of the form so as to realize at least partially the advancement system of the train. In particular, actuators 22 (for example hydraulic pistons or electric gear motors with linear mechanical transmission) may also be provided between the two parts for performing at least partly this relative movement of the two parts.

The front part, if present, may comprise various systems for preparing the tunnel for lining with the solidifiable fluid material. These systems will be provided and used depending on the type of preparation required or preferred.

For example, the front part may comprise a milling machine 35, per se of the known type, suitable for removing material from the tunnel wall before the rear part passes through in order to line the wall with the solidifiable fluid material. Here for the sake of simplicity, the term "milling machine" will be understood as meaning any known means suitable for removing material from the walls. For example, alternatively it may also be a hydro-demolition machine.

The front part may also comprise a section 36, per se of the known type, for emitting waterproofing liquid, designed to spray the waterproofing liquid towards the tunnel walls before the rear part passes through in order to line the wall with the solidifiable fluid material.

The processing train moves advantageously by means of a motorized thrusting/traction system realized by means of actuators (for example pistons and/or motorized endless screws) which cause sequential advancement of the various sections. For example, in order to exert the propelling force, it is possible to produce mechanically a locking action, alternately upstream or downstream, by means of the friction generated by a counter-force exerted on the tunnel walls. This friction may be obtained by means of a suitable system of movable gates.

For example, the processing train according to the invention may optionally comprise one or more sections 23, 24 for locking the sliding movement along the tunnel. These locking sections may be arranged in front of, behind or both in front of and behind the sliding form. In particular, they may be situated in the rear section 10*a* and/or in the front section 10*b*, if the processing train is divided up so.

In FIGS. 2, 3 and 4 the locking sections 23, 24 are shown by way of example both in front and behind. It is understood, however, that a processing train according to the invention may have only one of them or even none, if it is considered to be preferable. This will also depend on the sliding capacity of the train in the tunnel and the resistance to its advancing movement, as will be clear below to the person skilled in the art.

Figure 5:
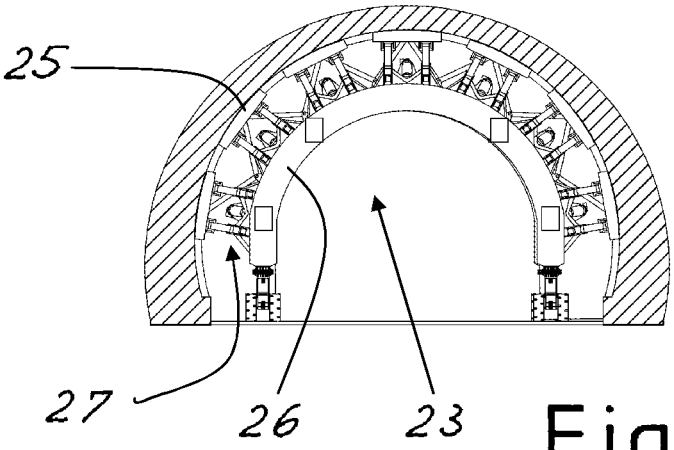
FIG. 5 shows a schematic cross-sectional view of the processing train according to FIG. 2.

A first locking section or rear locking section, denoted by 23, may be present behind the form 13. As is also shown in FIG. 5, the locking section 23 comprises associated elements 25 for controlled locking against the tunnel wall. These elements 25 are movable on command between an operative position radially projecting towards the walls of the tunnel (visible for example in FIG. 2) so as to be able to rest against the tunnel wall and prevent the sliding movement along the tunnel, and retracted rest position (visible for example in FIG. 4).

As can be seen in FIG. 5, the locking elements 25 may be arranged so as to form segments of a generally semi-cylindrical surface which matches the shape of the tunnel cross-section.

For the movement between operative position and non-operative position, the locking elements are supported on a frame 26 by means of articulated joints 27 and operated by actuators 28.

Advantageously, between the sliding form 13 and the rear locking section 23 there may be optionally arranged second controllable drives 29 designed to move the sliding form and the rear locking section 23 towards or away from each other so as to realize at least partly the advancing system, as will become clear below.

A second locking section or front locking section, denoted by 24, may be present in front of or in the front section 24. The locking section 24 may be identical to the rear section 23 already described and therefore comprises associated elements 30 for control locking against the tunnel wall. These elements 30 are movable on command between an operative position radially projecting towards the walls of the tunnel so as to be able to rest against the tunnel wall and prevent the sliding movement along the tunnel, and a retracted rest position.

In a manner similar to the locking elements 25, the locking elements 30 may be arranged so as to form segments of a generally semi-cylindrical surface which matches the shape of the tunnel cross-section.

For the movement between operative position and non-operative position, the locking elements are supported on a frame 31 by means of articulated joints 32 and operated by actuators 33.

Advantageously, between the front part 10*b* of the processing train and the front locking section 24 there may be optionally arranged first controllable drives 34 designed to move the front part 10b and the front locking section 24 towards or away from each other so as to realize at least partly the advancing system, as will become clear below.

When using a front locking section the counter-force of the fore carriage is exerted on the existing walls of the tunnel, causing a pressure such as not to adversely affect the structural stability thereof, which may already be precarious. Advantageously, the effect of this pressure, in addition to ensuring the frictional locking action necessary for the advancing movement, is also that of relieving the stress in the shell arch situated closest to the demolished or removed part, said operation resulting in weakening of the existing lining upstream of the operations, both in the transverse direction of the arch and in the longitudinal direction with respect to the tunnel axis. The length of the gates is defined depending on the type and condition of the existing lining.

The counter-force of the rear carriage is instead exerted on the new extruded lining and the size of the gates which form the locking elements may be determined by the mechanical performance of the material of the new lining which is achieved when the counter-pressure is exerted on the lining.

The system for performing frictional locking by means of a counter-force exerted against the (new or existing) tunnel lining is such that the method may also be carried out on a circular tunnel section (e.g. tunnels for the transportation of water, urban sewers, conduits) with a "full round" or telescopic form.

In the embodiments of the train shown in FIGS. 1 and 6 to 12 the locking sections 23, 24 are not present, but they may also be used in these embodiments if necessary or desired.

Reference will now to be made to these figures for a further description of the method and possible operating steps of a processing train according to the invention.

Figure 6:
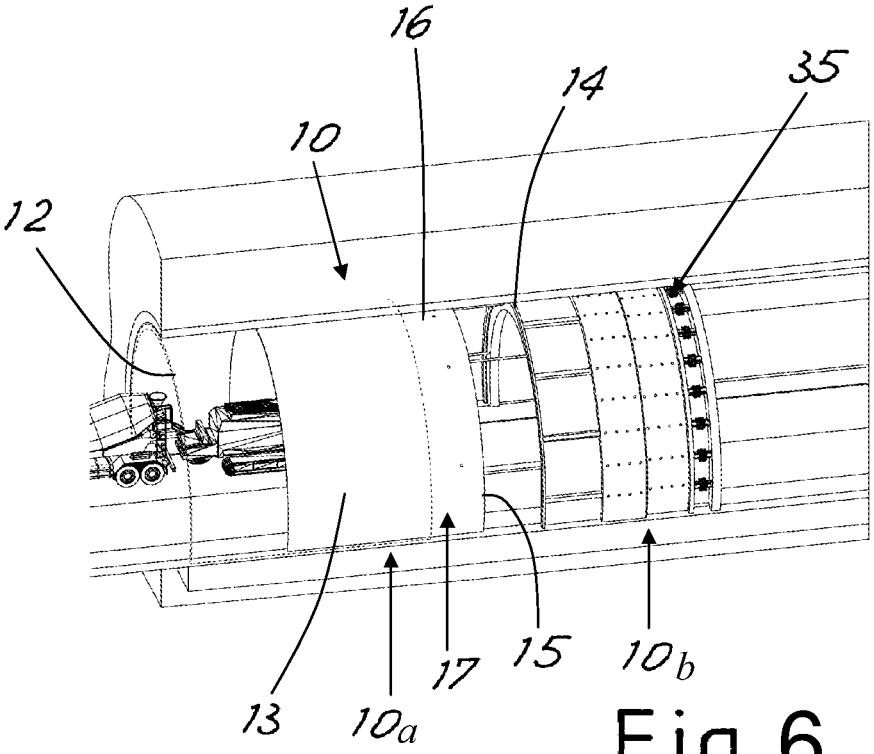
FIGS. 6 to 12 show schematic, partial perspective views of the processing train according to FIG. 1, during various possible operating steps.

FIG. 6 shows an intermediate step where the processing train is already operating along an internal section of the tunnel (for simpler illustration the lining layer 12 already formed is indicated by means of a broken line). In this figure the closing edge 14 can be seen in its non-operative position such that a free section is defined between it and front edge of the form 15. Furthermore, the form is in its position advanced by one step so as to define the interspace 16 for filing a new segment with the solidifiable fluid material.

Figure 7:
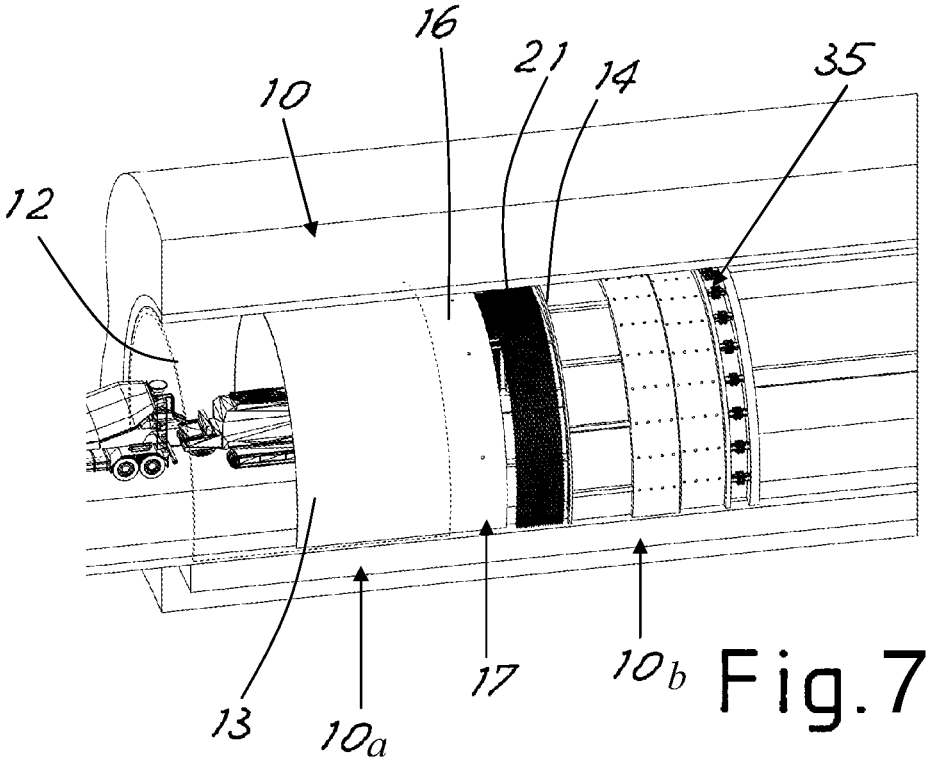

In FIG. 7 the reinforcement 21, where present, is positioned completely inside the space between the form and the closing edge 14. As stated above, the reinforcement may be formed for example by segments which are assembled on-site.

Figure 8:
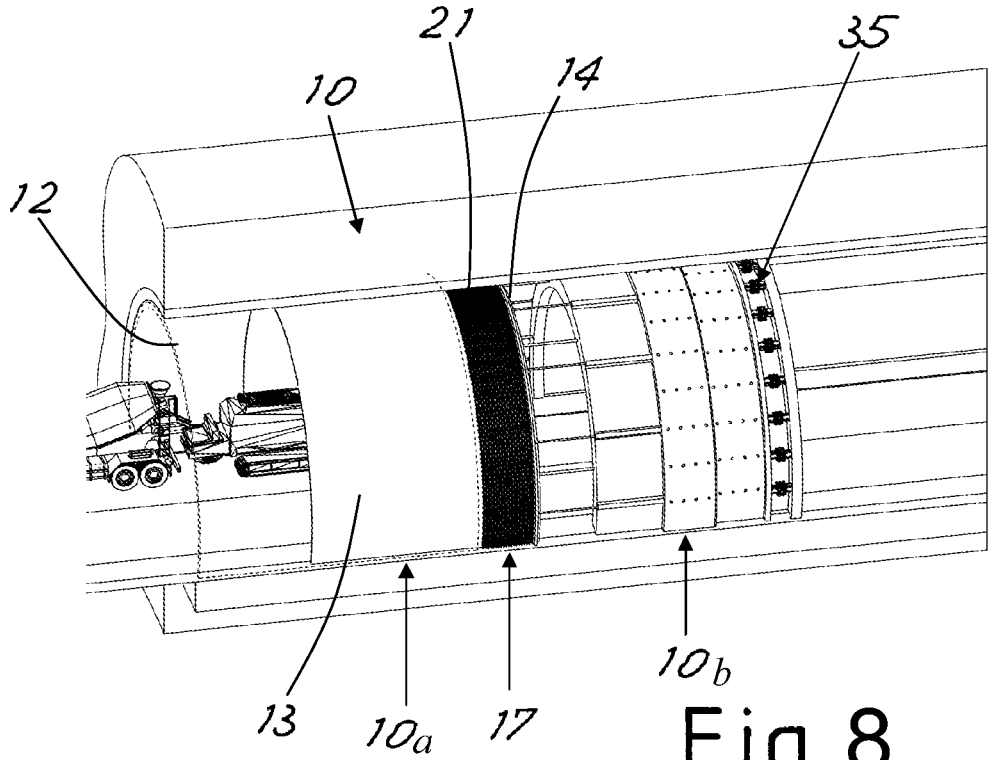
Figure 9:
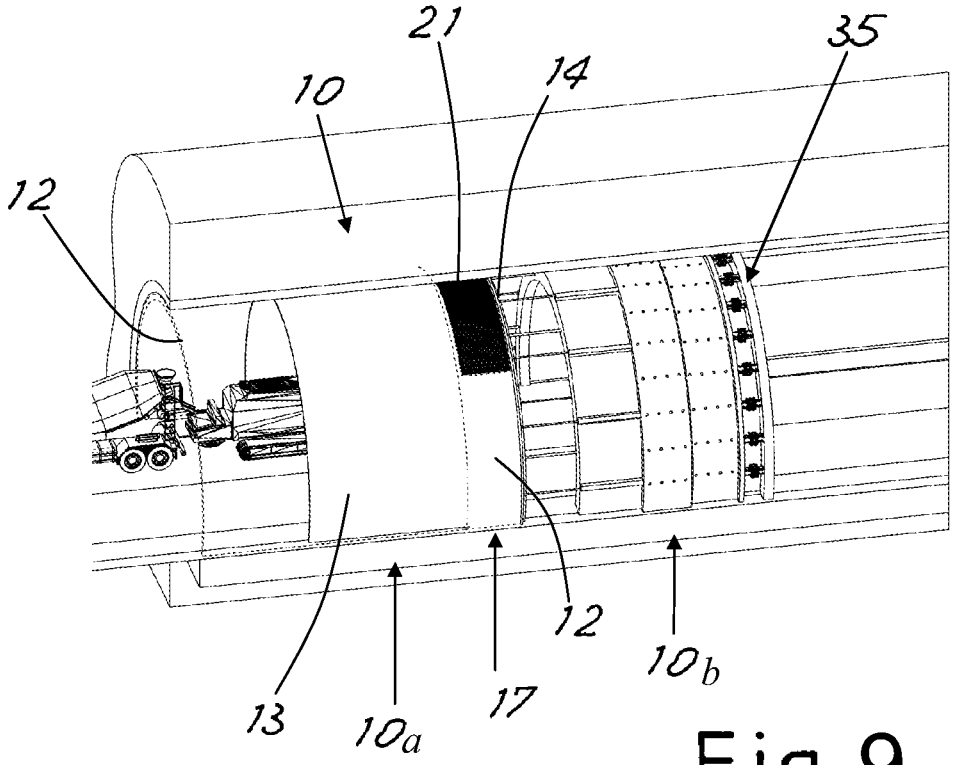

In FIG. 8 the closing edge is displaced into its operative position so as to push the reinforcement inside the interspace 16. FIG. 9 shows an intermediate step involving filling of the interspace 16 with the solidifiable fluid material. For example, the dispensing spouts 18 may be operated in sequence from the bottom upwards so as to fill in a uniform manner the interspace with the material which rises up towards the vault of the tunnel. The tunnel wall may have already been prepared by the front part of the train which has already passed by this tunnel section (for example removing with the milling machine the old lining and spraying it if necessary with a waterproofing liquid).

Figure 10:
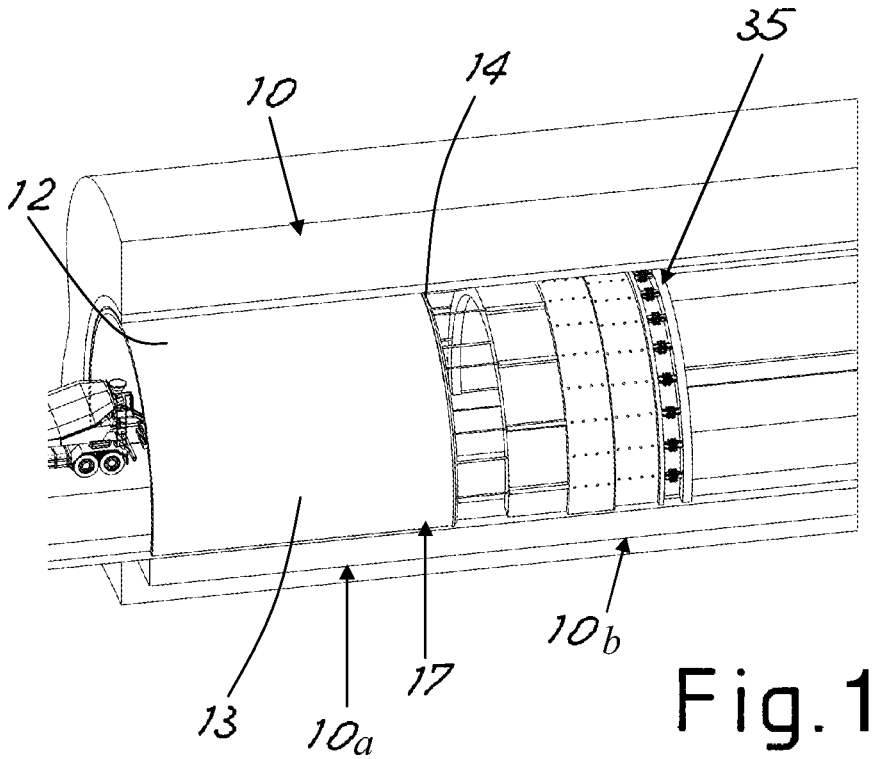

In FIG. 10 filling of the interspace has been completed and the lining layer formed up to that point is shown in solid lines for greater clarity.

At this point the sliding form 13 may be to advance by one step so as to form a new interspace 16 in front of the lining segment which has just been formed. The forwards movement may be produced by pulling or pushing the form along the tunnel by means of its advancement systems. For example, if the rear locking section 23 is provided, it may be operated into its locking position and the advancement actuators may push the form from the rear, by applying force on the locking section. Alternatively, if the front part in front of the form is provided, the form may also be pulled towards the front section and may be locked by its locking section 24, if present.

Figure 11:
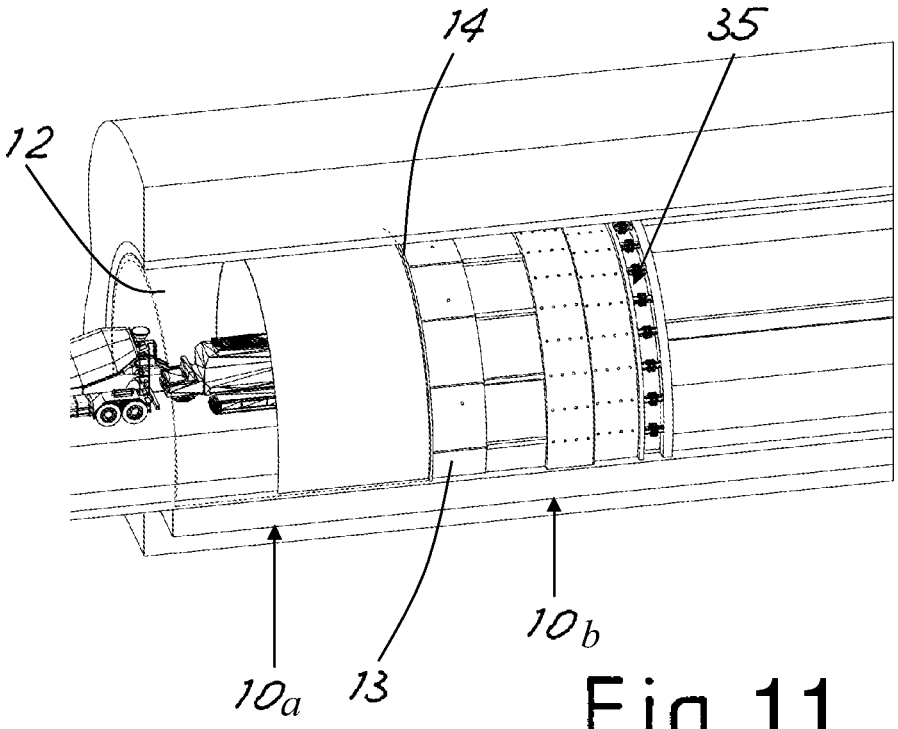
Figure 12:
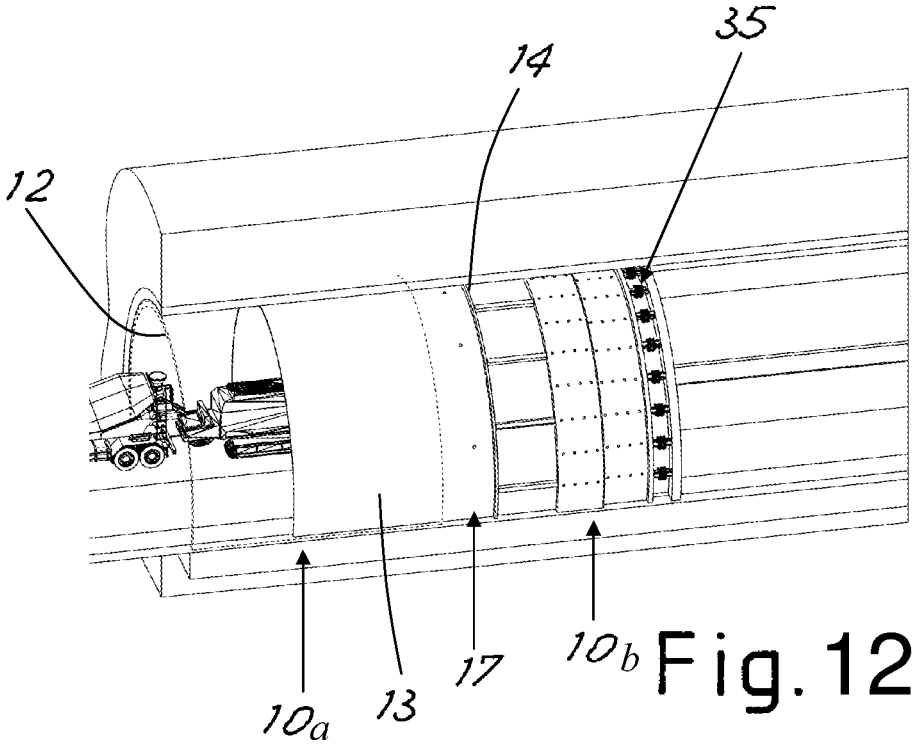

If considered preferable or necessary, both systems may be present and used, such that the form is simultaneously pushed from behind and pulled from the front. FIG. 11 shows the form which has advanced by one step and which has thus reached the front part of the processing train. Advantageously, the closing edge is still in its previous position so as to keep the fluid material which has not yet completely solidified stationary and prevent any forwards sliding thereof. In the figure it is clear how the lining segment which has just been extruded in the interspace is still supported by the form and will continue to be so during the next few steps. By suitably defining the dimensions of the form length, the forwards advancement by one step and the time between steps it is possible to ensure that, when the lining segment exits the rear part of the form, it is already suitably solidified such that it is self-supporting and no longer needs to be supported by the form.

After the forwards sliding movement of the form by one step and a suitable time for partial solidification of the fluid material so that there is no longer any need for the front edge, the closing edge may be moved forwards (FIG. 12) and then the front section moved forwards so as to prepare a new tunnel section for subsequent lining.

The forwards movement of the front part of the train may be performed for example by pushing forwards the front part, with the actuators applying force on the rear part, where necessary locked by its rear locking section 23 (if present). In addition or alternatively, if the front locking section 24 is present, this section may also be locked against the walls of the tunnel and the front part may be pulled forwards by the drives present between the front part and the front locking section During the forwards movement of the front part, the milling machine 35, where present, may remove a new section of the old lining and the wall may be sprayed with waterproofing liquid or undergo the further known treatments envisaged before performing the new lining (for example, the installation of self-drilling bolts). The train is thus again in the condition shown in FIG. 8, but advanced by one step, namely with a new lining segment deposited on the tunnel walls. The cycle may thus be resumed again as already described above.

At this point it is clear how the objects of the invention have been achieved and how a method and a processing train according to the invention may produce the lining of a tunnel in a continuous or semi-continuous manner, with a high degree of efficiency, with a high production speed and also in a completely automated manner.

The solidifiable fluid material may be any suitable solidifiable fluid material for the construction of tunnel linings with suitable characteristics. A mixture with cement-based binder may be used, or different categories of materials, not necessarily made with cement-based binders, may be used, these being suitably designed so as to ensure the necessary performance. For example, concrete made on-site, ready-mixed concretes, low-density concrete, thixotropic mortars, geopolymers, etc., may be used.

The mechanical characteristics of the fluid material which can be used may be characterized for example by a high thixotropy in the plastic state and the capacity to maintain its shape without the use of conventional static formwork; a suitable workability; the development of a high mechanical strength in sufficiently short curing times.

The most important parameter which governs control of the advancing movement of the system is the mechanical strength of the material in the section which exits at the rear of the sliding form. For example, it is possible to envisage using a material which is exposed behind the moving form only if a minimum compressive strength of 8 MPa is reached.

Fibres of different kinds and types depending on the performance features which are to be obtained may also be used in the mix, as is known to the person skilled in the art. The fibres may be introduced both in order to control the viscosity of the material and to obtain a suitable performance as regards the mechanical tensile strength and toughness of the matrix itself.

The preferred characteristics of the mixtures used will be a relatively high workability during mixing, transportation and pumping, filling capacity without the need for vibration, capacity to maintain its shape after suitably short drying times so as to ensure compatibility with the sliding times programmed for the moving form used and also develop a significant mechanical strength.

Furthermore, the fluid material used preferably produces a limited hydration heat and has a suitable retraction compensation and controlled expansion capacity. Finally, it is useful for the fluid material to have a low adhesiveness, or high flow capacity on the surface of the form, or low adhesion, with or without the use of additives for aiding extraction from the form.

By way of a non-limiting example, a solidifiable fluid material which may have the following nominal mechanical strength curve within 60 minutes from the moment the mixture water is added may be used:

| t [min] | $f_{cd}$ [MPa] |
|---|---|
| 5 | 0.63 |
| 10 | 1.26 |
| 15 | 1.89 |
| 20 | 2.52 |
| 25 | 3.15 |
| 30 | 3.78 |
| 35 | 4.41 |
| 40 | 5.05 |
| 45 | 5.68 |
| 50 | 6.31 |
| 55 | 6.94 |
| 60 | 7.57 |

Owing to the principles of the present invention, the stepwise process may be substantially continuous and the tunnel (for example repaired with replacement of an old lining) may have quality and durability standards which are even higher than the previous ones or those which would be obtained with the known methods, since the construction process according to the invention eliminates the construction joints, which are weak points as regards both the structure and the risk of infiltrations, and, if required, also ensures continuous waterproofing also without joints.

The same technology may also be used for the extrusion of new tunnel linings excavated using conventional advancement methods, obviously with elimination of the front demolition section which comprises the milling machine.

The speed of advancement of the system, once the characteristics of the material have been established, depends basically on the dimensions of the cross-section of the tunnel, the lining thickness which is to be produced, the length of the sliding form and the pumping capacity of the system.

For example the table below summarizes the approximate duration of a possible cycle with the steps forming it, simulating a system based on the characteristics of the material indicated above and with an internal radius of the lining of 7.5 m, repair thickness of 30 cm, form length of 12 metres, mixture injection throughput of 60 $m^3/h$, cycle advancement of 2 metres in the longitudinal direction. The injection of the mixture of solidifiable fluid material is performed from the bottom upwards in four successive steps.

| Description | $t_{accumulated}$ [min] | [sec] |
|---|---|---|
| Mixture injection-step 1 | 0' | 0" |
| Mixture injection-step 2 | 5' | 35" |
| Mixture injection-step 3 | 11' | 10" |
| Mixture injection-step 4 | 13' | 45" |
| Actuation of sliding form | 17' | 43" |
| Advancement of forecarriage | 22' | 43" |
| Retraction of form closing edge | 23' | 43" |
| Reinforcement-Positioning of cages | 33' | 43" |
| Advancement of form closing edge | 34' | 43" |

Obviously, the above description of embodiments applying the innovative principles of the present invention, the mixtures used and the time needed during the various steps are shown by way of example of these innovative principles and therefore cannot be regarded as limiting the scope of the rights claimed herein.

For example, parts of the processing trains may be absent, be added or may also be duplicated depending on the specific working requirements. Moreover, although figures have been shown where the tunnel has a vault-like cross-section with a flat roadway, the system may obviously be used also for railway tunnels or also tunnels with a generally circular cross-section, such as water transportation tunnels (e.g. hydroelectric stations), urban conduit systems, large-size sewage ducts, etc., as will now be clear to the person skilled in the art on the basis of the description of the invention provided herein.

Obviously, if a reinforcement inside the lining is not required, it may not be provided and the corresponding reinforcement insertion steps described above will not be required.

If the specific repair work or lining construction work does not require any auxiliary and/or preparatory operations, the rear part with the sliding form and its closing edge (fixed or movable depending on requirements) will be sufficient. Furthermore, in the case where removal of an existing lining is not necessary, the production of the new lining may be performed directly against the existing lining so that the latter is covered with the new lining.

Finally, the advancement of the form and the front part may be performed integrally, and the two parts may be pulled or pushed together by means of the front and/or rear locking means.

The invention claimed is:

1. A processing train configured to run along a tunnel so as to lay a solidifiable fluid material on a wall of the tunnel and allow the solidifiable fluid material to solidify for construction of a lining of the tunnel, the processing train comprising:

a sliding form with a lateral shape of a desired lining on the wall of the tunnel;

an advancement system suitable for advancement of the sliding form stepwise along the tunnel;

a closing edge adapted to close, radially with respect to the tunnel, a space between a front edge of the sliding form and the wall of the tunnel; and spouts for dispensing the solidifiable fluid material around a radially external front segment of the sliding form, wherein the processing train is divided into a rear part and a front part interconnected with each other, the sliding form being in the rear part and the front part being adapted to prepare the wall of a section of the tunnel for lining with the solidifiable fluid material, wherein the rear part and the front part are interconnected so that the rear and front parts are movable towards and away from each other on command in a stepwise advancing direction of the sliding form to realize at least partially the advancement system, wherein behind the sliding form there is a rear locking section for locking a sliding movement along the tunnel, the rear locking section comprising associated elements which perform locking against the wall of the tunnel and which are movable on command between an operative position projecting radially towards the wall of the tunnel and a retracted rest position, and wherein in the front part or in front of the front part there is a front locking section for locking the sliding movement along the tunnel, the front locking section comprising associated elements which perform locking against the wall of the tunnel and which are movable on command between an operative position projecting radially towards the wall of the tunnel and a retracted rest position.

2. The processing train of claim 1, wherein the closing edge is movable between an operative position against the front edge of the sliding form and a non-operative position spaced from the operative position.

3. The processing train of claim 1, wherein the front part comprises a milling machine or a hydro-demolition machine suitable for removing material from the wall of the tunnel before passage of the rear part for lining the wall with the solidifiable fluid material.

4. The processing train of claim 1, wherein the front part comprises a section for emission of waterproofing liquid, suitable for spraying the waterproofing liquid towards the wall of the tunnel before passage of the rear part for lining the wall with the solidifiable fluid material.

5. The processing train of claim 1, wherein between the sliding form and the rear locking section there are second controllable drives suitable for moving the sliding form and the rear locking section towards or away from each other so as to realize at least partially the advancement system.

6. The processing train of claim 1, wherein between the front part and the front locking section there are first controllable drives suitable for moving the front part and the front locking section towards or away from each other so as to realize at least partially the advancement system.

7. A method for constructing a lining of a tunnel with a solidifiable fluid material by a processing train configured to run along the tunnel so as to lay the solidifiable fluid material on a wall of the tunnel and allow the solidifiable fluid material to solidify for construction of the lining of the tunnel, the processing train comprising:

a sliding form with a lateral shape of a desired lining on the wall of the tunnel;

an advancement system suitable for advancement of the sliding form stepwise along the tunnel;

a closing edge adapted to close, radially with respect to the tunnel, a space between a front edge of the sliding form and the wall of the tunnel; and spouts for dispensing the solidifiable fluid material around a radially external front segment of the sliding form, wherein the processing train is divided into a rear part and a front part interconnected with each other, the sliding form being in the rear part and the front part being adapted to prepare the wall of a section of the tunnel for lining with the solidifiable fluid material, wherein the rear part and the front part are interconnected so that the rear and front parts are movable towards and away from each other on command in a stepwise advancing direction of the sliding form to realize at least partially the advancement system, wherein behind the sliding form there is a rear locking section for locking a sliding movement along the tunnel, the rear locking section comprising associated elements which perform locking against the wall of the tunnel and which are movable on command between an operative position projecting radially towards the wall of the tunnel and a retracted rest position, and wherein in the front part or in front of the front part there is a front locking section for locking the sliding movement along the tunnel, the front locking section comprising associated elements which perform locking against the wall of the tunnel and which are movable on command between an operative position projecting radially towards the wall of the tunnel and a retracted rest position, the processing train being advanced stepwise along an axis of the tunnel, the method comprising:

a) using the sliding form with the lateral shape of the desired lining on the wall of the tunnel and extending over the section of the tunnel, so as to define an interspace between the radially external front segment of the sliding form and the wall of the tunnel, the interspace being closed at the front by the closing edge which extends radially with respect to the axis of the tunnel between the sliding form and the wall of the tunnel;

b) introducing the solidifiable fluid material into said interspace;

c) waiting for a given solidification time;

d) advancing the sliding form by one step inside the tunnel so as to form a new interspace situated between the radially external front segment of the sliding form and the wall of the tunnel and bordering at the rear with the solidifiable fluid material introduced into a preceding interspace; and e) repeating steps b) to d) to create successive lining sections of the tunnel.

8. The method of claim 7, wherein advancement in step d) is such as to keep the sliding form still against the solidifiable fluid material introduced into the interspace at least in the immediately preceding step c).

9. The method of claim 7, wherein the closing edge is configured to be movable between an operative position to close the interspace at the front and a non-operative position spaced from the sliding form to open at the front the interspace, and wherein, before introducing the solidifiable fluid material into the interspace, the following further steps are carried out:

moving the closing edge into the non-operative position;

introducing into the interspace a reinforcement to be incorporated in the solidifiable fluid material which is subsequently introduced into the interspace; and closing the interspace with the closing edge in the operative position.

10. The method of claim 9, wherein, in order to introduce the reinforcement into the interspace, the reinforcement is placed between the sliding form and the closing edge in the non-operative position and then the closing edge is moved towards the operative position so that the closing edge pushes the reinforcement towards and inside the interspace.

11. The method of claim 7, wherein in the front part a step of preparation of the wall of the section of the tunnel is carried out before an advancement of the processing train brings the sliding form opposite the section of the tunnel.

12. The method of claim 11, wherein the front part comprises a milling machine or a hydro-demolition machine and, as a step for preparation of the wall of the tunnel, the milling machine is operated to remove material from the wall.

13. The method of claim 11, wherein the front part comprises a section for emission of a waterproofing liquid towards the wall of the tunnel and, as a step for preparation of the wall of the tunnel, the waterproofing liquid is sprayed onto the wall of the tunnel.

14. The method of claim 11, wherein in front of the front part or in the front part there is a front locking section for a controlled locking of a sliding movement of the front locking section along the tunnel, wherein between the front part and the front locking section there are first controllable drives for moving the front part and the front locking section towards or away from each other, and wherein said first controllable drives are controlled to move at least part of the processing train along the tunnel while locking of the front locking section is performed.

15. The method of claim 11, wherein behind the sliding form the rear part comprises a rear locking section for a controlled locking of a sliding movement of said rear locking section along the tunnel, wherein between the sliding form and the rear locking section there are second controllable drives for moving the sliding form and the rear locking section towards or away from each other, and wherein said second controllable drives are controlled to move at least part of the processing train along the tunnel while locking of the rear locking section is performed.

* * * * *